United States Patent [19]

Peden

[11] Patent Number: 4,729,227

[45] Date of Patent: Mar. 8, 1988

[54] ERECTABLE SLEEVE

[75] Inventor: James H. Peden, Dayton, Tenn.

[73] Assignee: Suburban Manufacturing Company, Dayton, Tenn.

[21] Appl. No.: 15,720

[22] Filed: Feb. 17, 1987

[51] Int. Cl.[4] ..... F25D 23/12

[52] U.S. Cl. ..... 62/263; 98/114

[58] Field of Search ..... 62/262, 263; 98/94.2, 98/114; 165/78, 76

[56] References Cited

U.S. PATENT DOCUMENTS

| | | | |
|---|---|---|---|
| 2,282,733 | 5/1942 | Malloy . | |
| 2,728,935 | 1/1956 | Maher . | |
| 3,336,715 | 8/1967 | Savary . | |
| 3,386,434 | 6/1968 | Castello et al. . | |
| 3,677,517 | 7/1972 | Root et al. . | |
| 3,815,638 | 6/1974 | Martin | 98/114 X |
| 4,006,672 | 2/1977 | Matsuyoshi | 98/114 X |

*Primary Examiner*—Henry A. Bennett

*Attorney, Agent, or Firm*—Amster, Rothstein & Ebenstein

[57] ABSTRACT

An erectable sleeve is movable between a relatively flat collapsed orientation and a relatively high rectangular erected orientation for use. The sleeve comprises a bottom member and a pair of end members, each end member being pivotally secured to a respective end of the bottom member and pivotable between a folded position wherein the end member is substantially parallel to the bottom member and an extended position wherein the end member is extended substantially perpendicular to the bottom member. A detachable top member includes friction fit means for engagingly receiving the free ends of the end members for maintaining the end members in their extended position.

18 Claims, 4 Drawing Figures

FIG. 1
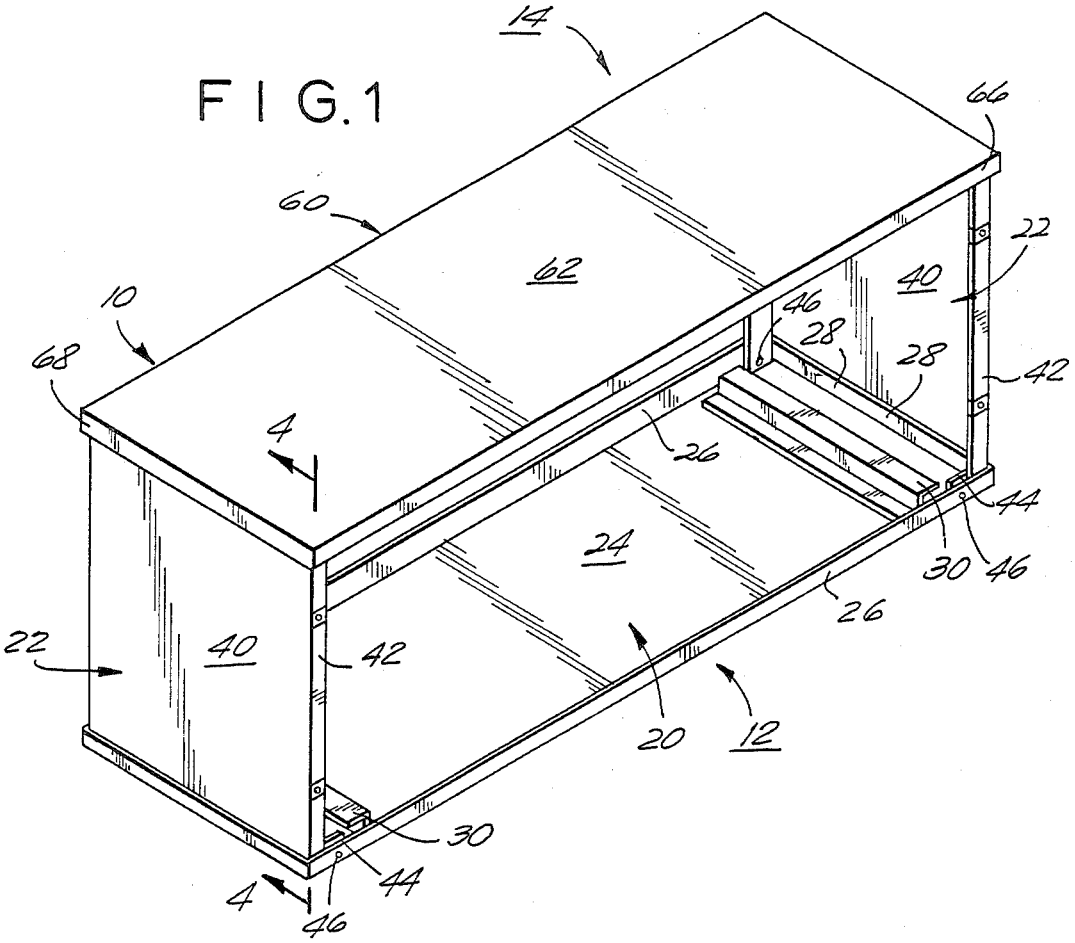
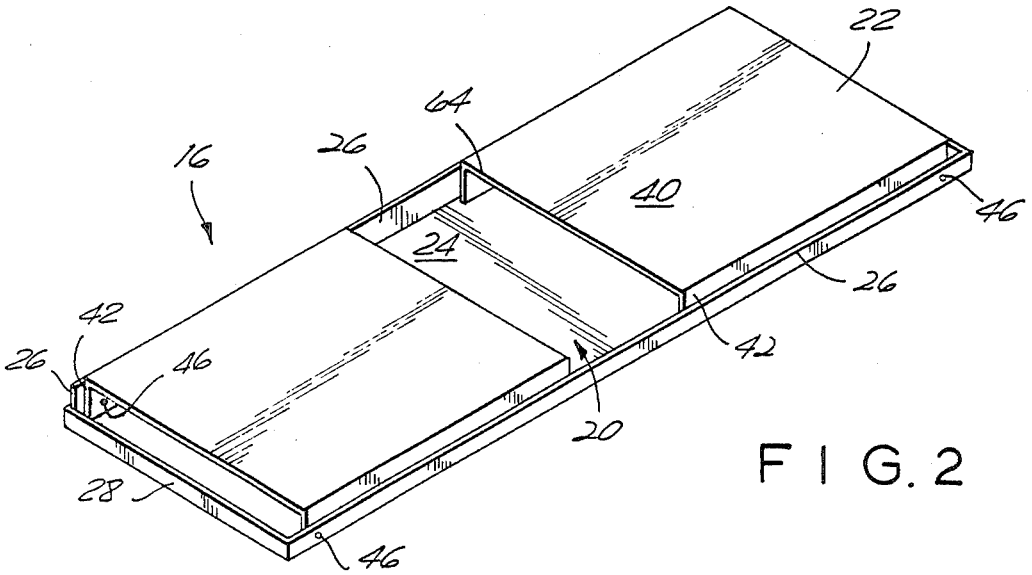
FIG. 2

ERECTABLE SLEEVE

BACKGROUND OF THE INVENTION

The present invention relates to a sleeve for receiving, to project therethrough, a unit of generally rectangular cross section such as a heater or air conditioner, and, more particularly, an erectable sleeve having a compact orientation for storage and an extended orientation for use.

Protective sleeves, for air conditioners, heating units and the like extending through an exterior building wall, have heretofore been bulky, hard to handle, costly to transport to the construction site and inconvenient to store at the construction site. Such a sleeve acts both as a support and as a protective housing for the unit and, as such, must combine a high level of structural strength with water-seal integrity.

The advantages of a sleeve which could be manufactured and stored in a collapsed condition and erected into a bulky but useful shape only when needed are self evident. Such an erectable sleeve should be erectable, without the use of tools, to easily and rapidly form a rigid, relatively permanent structure of high strength and stability. Exemplary of the attempts to form such erectable structures in the past have been U.S. Pat. Nos. 2,282,733; 3,336,715; 3,386,434 and 3,677,517. Additionally U.S. Pat. No. 2,728,935 discloses a collapsible shoeshine box. The products disclosed by these patents have not been entirely satisfactory, however, some failing to provide the necessary degree of compactness in the broken-down or non-erected orientation, others failing to provide a sufficiently locked and stable structure in the erected orientation.

Accordingly, it is an object of the present invention to provide an erectable sleeve having a very low profile in the non-erected orientation.

Another object is to provide such a sleeve having in its erected orientation a locked and stable configuration.

A further object is to provide such a sleeve which is simple to manufacture, simple to erect without the use of tools and yet provides a water-tight seal for the unit projecting therethrough.

SUMMARY OF THE INVENTION

It has now been found that the above and related objects of the present invention are obtained in an erectable sleeve for receiving, to project therethrough, a unit of generally rectangular cross-section such as a heater or air conditioner. The sleeve includes members movable between a relatively flat collapsed orientation for storage and a relatively high rectangular erected orientation for use.

The sleeve comprises two segments, the first segment comprising a bottom member having a generally flat web section and a pair of end members and the second section comprising a detachable top member. Each end member has a generally flat web section and one end thereof pivotally secured to a respective end of the bottom member and being pivotable between a folded position and an extended position. In the folded position the end member web section extends generally parallel to the bottom member web section, and in the extended position the end member web section extends generally perpendicularly to the bottom member web section. The top member has a generally flat web section and means adapted to engagingly receive the free ends of the end members for maintaining the ends members in their extended position.

In a preferred embodiment of the present invention each of the end members has inwardly turned side flanges and the top member maintaining means comprises downwardly turned side flanges, downwardly turned end flanges, and a pair of downwardly extending locking flanges secured to the top member web section. Each locking flange extends closely parallel to respective one of the top member end flanges to define a first gap for substantially the entire length thereof, but terminating short of the top member side flanges to define second gaps. The top member is adapted to maintain the end members in their extended position by receiving portions of the end members side flanges in the second gaps intermediate the top member locking flanges and the top member side flanges and by receiving portions of the end member web sections in the first gaps intermediate the locking flanges and the top member end flanges.

Preferably the bottom member has upwardly turned side flanges and upwardly turned end flanges. The end member side flanges are pivotally hinged on the bottom member side flanges, and the end member web section in the extended position is disposed inwardly of the bottom member end flange. The bottom member side flange, the top member side flange, and the end member side flanges at the rear of the sleeve extend substantially uniformly further inwardly than their counterparts at the front of the sleeve for sealingly engaging the sleeve to the unit. The end member side flanges at the front of the sleeve define tabs extending as far as the ones at the rear of the sleeve and defining pivot points for the front of the end members. The flanges at the rear of the sleeve carry thermal insulation on the front surface of the free ends. The end member side flanges at the rear of the sleeve define centrally cut-out slots, cut down to the level of the end member side flanges at the front of the sleeve, to leave a passage for auxilliary units through the slots.

Portions of the bottom member are resiliently flexible to resistingly permit movement of the end members between the folded and extended positions, preferably resistingly retaining the end members in the folded position until they are forcibly moved out of such position.

The sleeve may be erected without the use of tools, the detachable top member receiving and locking the ends of the end members with a friction fit. The sleeve is erected by moving the end members to the extended position and positioning the top member atop the free ends of the end members to maintain the end members in the extended position. Portions of the end members' side flanges extend intermediate the top member locking flanges and the top member side flanges and portions of the end member web sections extend intermediate the locking flanges and the top member end flanges.

BRIEF DESCRIPTION OF THE DRAWING

The above brief description as well as further objects and features of the present invention, will be more fully understood by the reference to the following detailed description of the preferred, albeit illustrative, embodiment of the present invention when taken in conjunction with the accompanying drawing wherein:

FIG. 1 is an isometric view of an erectable sleeve of the present invention in the erected state;

FIG. 2 is an isometric view of the bottom section of the erectable sleeve with the end members in the folded position;

DETAILED DESCRIPTION OF THE PREFERRED EMBODIMENT

Figure 3:
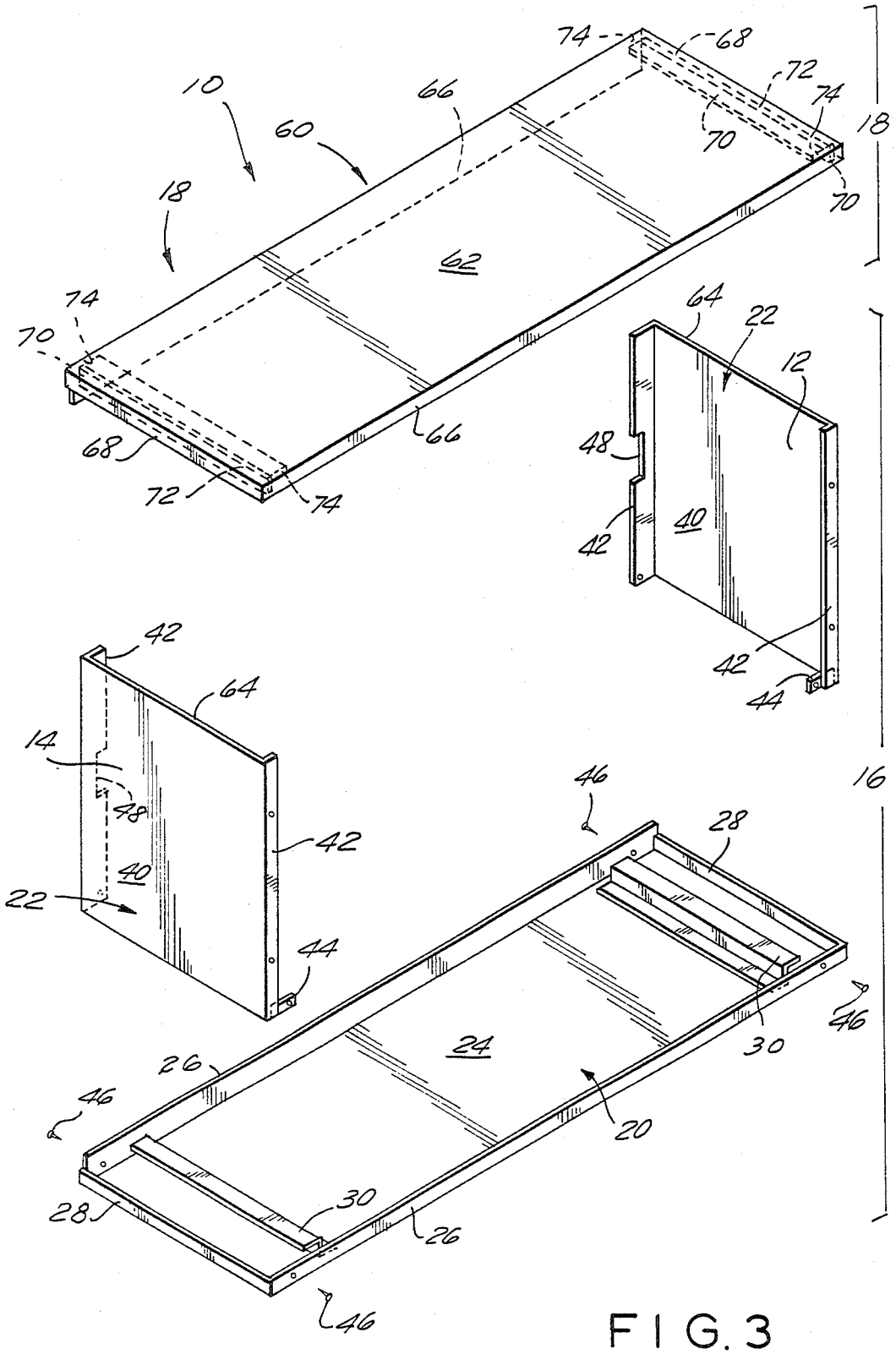
FIG. 3 is an exploded isometric view of the erectable sleeve.

Referring now to the drawing, and in particular FIGS. 1 and 3 thereof, therein illustrated is an erectable sleeve, generally designated by the reference numeral 10, according to the present invention. The sleeve 10 is illustrated in its erected orientation, ready to receive a unit of generally rectangular cross section (not shown) for projection therethrough. The unit, typically an air conditioner or heater, may be contained entirely between the front 12 and rear 14 of the sleeve, but more typically projects therefrom forwardly, rearwardly or both. The erected sleeve 10 is adapted to be inserted into an aperture in an exterior wall of a building, where it provides structural support and protection for the unit thereafter inserted therein. The sleeve 10 is generally sealed to the exterior wall defining the aperture by caulk, weather stipping or the like and, as will be noted hereinafter, provides a thermal seal with the unit disposed therein.

The sleeve 10 is composed of two sections 16, 18. The first section 16 is comprised of a bottom member, generally designated by the reference numeral 20, and a pair of end members, generally designated by the reference numeral 22. The bottom member 20 includes a generally flat web section 24, upwardly turned side flanges 26 and upwardly turned end flanges 28. The side flanges 26 and end flanges 28 meet at the corners and form a single raised peripheral rim for the bottom web section 24. Adjacent each end of the bottom web section 24, an S-shaped member 30 extending parallel to the end flanges 28, is welded to the bottom web section 24 to receive thereon the chasis of the unit to be disposed within the sleeve. Each end member 22 includes a generally flat web section 40 and inwardly turned side flanges 42. The front side flanges 42 define lugs 44 at the bottom thereof extending inwardly. The bottom end of each end member 22 is pivotedly secured to a respective end of the bottom member 20, and more particularly the end member side flanges 42 are pivotally hinged on the bottom member side flanges 26 by pivot members 46 extending therethrough both at the front 12 and back 14. More specifically, the pivot members 46 at the front of the sleeve extend inwardly first through the bottom member side flange 26 and then the lug 44 projecting from the end member side flange 42, while the pivot members 46 at the rear of the sleeve extend inwardly first through the bottom member side flange 26 and then the end member side flange 42. As a result, each end member 22 is pivotable between a folded position wherein the end member web section 40 extends generally parallel to the bottom member web section 24 (as shown in FIG. 2) and an extended position wherein the end member web section 40 extends generally perpendicularly to the bottom member web section 24 (as shown in FIGS. 1, 3 and 4), In the extended position the end member web section 40 is disposed inwardly of the bottom member end flange 28, but closely adjacent thereto.

Figure 4:
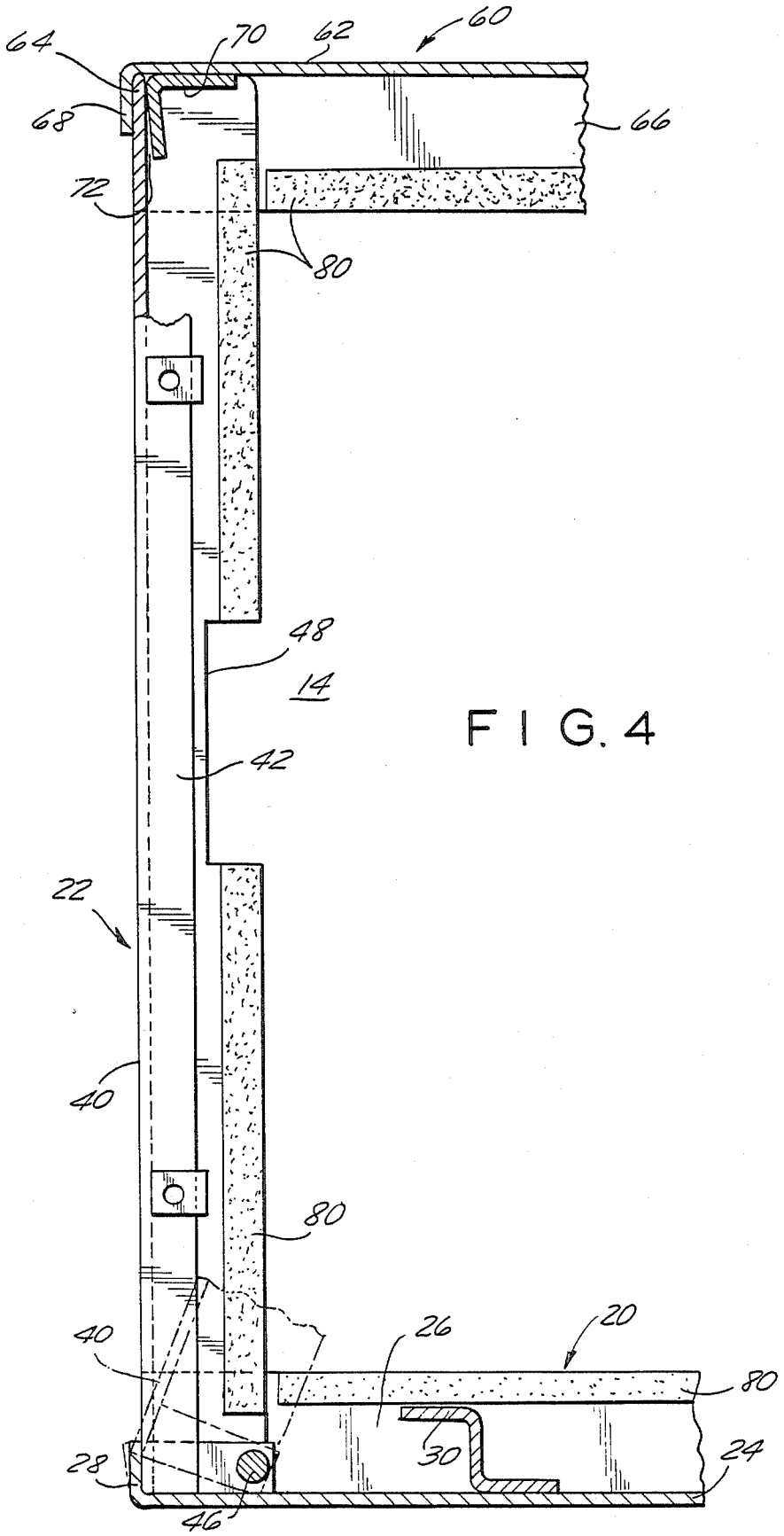
FIG. 4 is a side elevation view of the erectable sleeve, partially in cross section, partially broken away and to a greatly enlarged scale, taken generally along the line 4—4 of FIG. 1, showing in phantom line the position of the pieces as an end member is moved between its folded and extended orientations.

Referring now to FIG. 4, it will be appreciated that the pivot point 46 is sufficiently spaced from the bottom member end flange 28 and from the end member web section 40 that movement of the end members 22 between the folded and extended positions is resisted by the bottom member end flange 28 and somewhat by the bottom member web section 24, each of which must be slightly displaced (as shown in phantom line for the bottom member end flange 28) as the end member 22 moves either into or out of its extended orientation. As the entire sleeve is constructed of sheet metal exhibiting a strongly resilient flexibility, the bottom member 20 assists in maintaining the end members 22 in their current orientation. When the end members 22 are in the folded position (as shown in FIG. 2), the bearing thereon of the bottom member web section 24 resists movement of the end members out of the folded position. This reduces the possibility of the sleeve even partially erecting by accident prior to the time that it is intentionally erected.

Where the geometry of the unit so requires, the end member side flanges 42 at the rear 14 of the sleeve may be provided with centrally cut out slots 48. Such slots 48 may be required, for example, for units which are heaters of generally rectangular cross section but having auxilliary units such as an exhaust disposed outside of the generally rectangular cross section.

Referring now to FIGS. 1, 3 and 4 in particular, the second section 18 comprises a detachable top member generally designated by the reference numeral 60. The top member 60 has a generally flat web section 62 and means adapted to engagingly receive the free ends 64 of the end members 22 for maintaining the end members in their extended position. The maintaining means comprises downwardly turned side flanges 66, downwardly turned end flanges 68, and a pair of downwardly extending locking flanges 70. The side flanges 66 and end flanges 68 meet at the corners and form a single downwardly turned peripheral rim for the top of web section 62. Each locking flange 70 is disposed adjacent to and extends closely parallel to a respective one of the top member end flanges 68 to define a first gap 72 for substantially the entire length thereof, but terminating short of the top member side flanges 66 to define second gaps 74 (see FIG. 3). The top member 60 is adapted to maintain the end members 22 in their extended position by receiving portions of the end member side flanges 42 in the second gaps 74 intermediate the top member locking flanges 70 and the top member side flanges 66 and by receiving the free ends 64 of the end member web sections 40 in the first gaps 72 intermediate the locking flanges 70 and the top member end flanges 68. The engagements of the top member 60 with the locking flanges 70 and the end members 22 are preferably friction fit engagements to facilitate handling of the erected sleeve on the construction site without the sections 16 and 18 separating.

Referring now in particular to FIGS. 1 and 3, the bottom member side flange 20, the top member side flange 66 and the end member side flange 42 at the rear 14 of the sleeve extend substantially uniformly further inwardly than their counterparts at the front 12 of the sleeve. This enables the sleeve to thermally sealingly engage the unit disposed therein. To assist in this function the aforesaid flanges at the rear 14 of the sleeve carry thermal insulation 80 (shown only in FIG. 4) on the front surface of the free ends thereof to preclude the creation of currents passing intermediate the sleeve and the unit. The insulation 80 may be provided in strips having a pressure sensitive adhesive on one side to enable the strips 80 to be conveniently applied at the construction site to the erected sleeve. While application of insulation 80 may also be performed at the factory on the unerected sleeve, such factory-applied insulation would interfere with the close tolerances between various elements of the unerected sleeve (for example, the close tolerance between the rear surface of the end member side flange 42 at the rear of the sleeve and the front surface of the bottom member side flange 26 at the rear of the sleeve).

In the unerected state, the bottom section 16 has a height hardly greater than the minimum possible height determined by the height of the bottom member side flange 26 at the rear of the sleeve (see FIG. 2), and the top section 18 has a height equal to the top member side flange 66 at the rear of the sleeve. Nonetheless, the sleeve is easily erected at a construction site without the use of tools simply by moving the end members 22 to their extended position and then friction fit positioning the top member 60 atop the free ends 64 of the end members 22 to maintain the end members in their extended position. Portions of the end member side flanges 42 extend immediate the top member locking flanges 70 and the top member side flanges 66, and the free ends 64 of the end member web sections 40 extend intermediate the top member locking flanges 70 and the top member end flanges 68.

It will be appreciated that the slot 48 of the end member side flange 42 at the rear of the sleeve is generally cut down to the same level as the side flange 42 at the front of the sleeve. Further, it will be appreciated that the S-shaped member 30 welded to the bottom member 20 generally extends upwardly above the level of the bottom member side flange 26 at the front 12 of the sleeve 10 to enable the unit to be slipped onto the S-shaped member 30 from the front 12 of the sleeve, but not as high as the bottom member side flange 26 at the rear 14 of the sleeve so that the rear flange acts as a stop for the unit. Finally, it will be appreciated that the pivot members 46 engage the end member side flanges 42 at a point disposed inwardly of the end member side flange 42 at the front 12 of the sleeve, this being the reason for the inwardly projecting lugs 44.

To summarize, the present invention provides an erectable sleeve which is very compact in its unerected state, and yet is easily erectable without the use of tools to provide a protective supporting structure.

Now that the preferred embodiment of the present invention has been shown and described in detail, various modifications and improvements thereon will become readily apparent to those skilled in the art. Accordingly, the spirit and scope of the present invention is to be limited only by the appended claims, and not by the foregoing disclosure.

What is claimed is:

1. An erectable sleeve for receiving, to project therethrough, a unit of generally rectangular cross section comprising:

(A) a bottom member having a generally flat web section;

(B) a pair of end members, each end member having a generally flat web section and one end thereof pivotally secured to a respective end of said bottom member and being pivotable between a folded position wherein said end member web section extends generally parallel to and overlies said bottom member web section and an extended position wherein said end member web section extends generally perpendicularly to said bottom member web section; and (C) a detachable top member having a generally flat web section and means adapted to engagingly receive the free ends of said end members for maintaining said end members in their extended position.

2. An erectable sleeve for receiving, to project therethrough, a unit of generally rectangular cross section comprising:

(A) a bottom member having a generally flat web section;

(B) a pair of end members, each of said end members having inwardly turned side flanges, a generally flat web section and one end thereof pivotally secured to a respective end of said bottom member and being pivotable between a folded position wherein said end member section extends generally parallel to said bottom member web section and an extended position wherein said end member web section extends generally perpendicularly to said bottom member web section; and (C) a detachable top member having a generally flat web section and means adapted to engagingly receive the free ends of said end members for maintaining said end members in their extended position, said top member maintaining means comprising downwardly turned side flanges, downwardly turned end flanges, and a pair of downwardly extending locking flanges secured to said top member web section, each locking flange extending closely parallel to a respective one of said top member end flanges to define a first gap for substantially the entire length thereof but terminating short of said top member side flanges to define second gaps, said top member being adapted to maintain said end members in their extended position by receiving portions of said end member side flanges in said second gaps intermediate said top member locking flanges and said top member side flanges and by receiving portions of said end member web sections in said first gaps intermediate said locking flanges and said top member end flanges.

3. The sleeve of claim 2 wherein said bottom member has upwardly turned side flanges and upwardly turned end flanges.

4. The sleeve of claim 3 wherein said end member side flanges are pivotally hinged on said bottom member side flanges.

5. The sleeve of claim 3 wherein in said extended position said end member web section is disposed inwardly of said bottom member end flange.

6. The sleeve of claim 3 wherein said bottom member side flange, said top member side flange and said end member side flanges at the rear of said sleeve extend substantially uniformly further inwardly than their counterparts at the front of said sleeve for sealingly engaging said sleeve to the unit.

7. The sleeve of claim 6 wherein said flanges at the rear of said sleeve carry thermal insulation on the front surface of the free ends thereof.

8. The sleeve of claim 6 wherein said end member side flanges at the front of said sleeve define tabs extending as far as said end member side flanges at the rear of said sleeve and defining pivot points for the front of said end members.

9. The sleeve of claim 2 wherein said end member side flanges at the rear of said sleeve extend further than said end member side flanges at the front of said sleeve and define centrally cut-out slots, cut down to the level of said end member side flanges at the front of said sleeve, to enable passage of auxilliary units through said slots.

10. The sleeve of claim 2 wherein said sleeve is configured and dimensioned to receive, to project therethrough as the unit, an air conditioner.

11. The sleeve of claim 1 where portions of the said bottom member are resiliently flexible to resistingly permit movement of said end members between said folded and extended positions.

12. The sleeve of claim 11 wherein portions of said bottom member are resiliently flexible to resistingly retain said end members in said folded position until forceably moved out of said folded position.

13. The sleeve of claim 1 wherein said top member means for maintaining said end members in their extended position comprises friction fit means and said sleeve is erectable without tools.

14. The sleeve of claim 1 wherein said members are movable between a relatively flat collapsed orientation for storage purposes and a relatively high rectangular erected orientation for use purposes.

15. A method of erecting a sleeve for receiving a unit of generally rectangular cross-section comprising the steps of:

(A) providing a bottom member having a generally flat web section; a pair of end members, each end member having a generally flat web section and inwardly turned flanges, each end member having one end thereof pivotally secured to respective end of said bottom member and pivotable between a folded position wherein said end member web section extends generally parallel to said bottom member web section and an extended position wherein said end member web section extends generally perpendicular to said bottom member web section; and a detachable top member having a generally flat web section, downwardly turned side flanges, downwardly turned end flanges, and a pair of downwardly extending locking flanges secured to said top member web section, each locking flange extending closely parallel to a respective one of said top member end flanges for substantially the entire length thereof but terminating short of said top member side flanges;

(B) moving said end members to said extended position; and (C) positioning said top member atop the free ends of said end members to maintain said end members in said extended position with portions of said end member side flanges extending intermediate said top member locking flanges and said top member side flanges and portions of said end member web sections extending intermediate said locking flanges and said top member end flanges.

16. The sleeve of claim 14 wherein said members are movable between said orientation for storage purposes and said orientation for use purposes manually and without the use of tools.

17. The method of claim 15 wherein said end members are moved to said extended position and said top member is positioned atop the free ends of said end members manually and without the use of tools.

18. The sleeve of claim 1 wherein said members are formed of strongly resilient material.

* * * * *